US008561850B1

(12) United States Patent
Dawson

(10) Patent No.: US 8,561,850 B1
(45) Date of Patent: Oct. 22, 2013

(54) DEVICE FOR DISPENSING MATERIALS FROM A CONTAINER

(76) Inventor: Melvin L Dawson, Wyandanch, NY (US)

( * ) Notice: Subject to any disclaimer, the term of this patent is extended or adjusted under 35 U.S.C. 154(b) by 773 days.

(21) Appl. No.: 12/702,605

(22) Filed: Feb. 9, 2010

Related U.S. Application Data

(60) Provisional application No. 61/151,703, filed on Feb. 11, 2009.

(51) Int. Cl.
*B67D 7/06* (2010.01)

(52) U.S. Cl.
USPC ..... 222/191; 222/327; 222/391; 222/527; 222/537; 222/570

(58) Field of Classification Search
USPC ..... 222/174, 191, 325–327, 391, 526–537, 222/566–574, 541.9; 604/524–527, 530
See application file for complete search history.

(56) References Cited

U.S. PATENT DOCUMENTS

| | | | | |
|---|---|---|---|---|
| 1,296,045 | A * | 3/1919 | Campbell | 222/527 |
| 4,095,728 | A * | 6/1978 | Chlystun | 222/529 |
| 4,390,115 | A * | 6/1983 | Bigham | 222/326 |
| 4,817,832 | A * | 4/1989 | Nagy | 222/530 |
| 5,004,128 | A * | 4/1991 | Richichi et al. | 222/527 |
| 5,104,013 | A * | 4/1992 | Hawley | 222/566 |
| 5,368,206 | A * | 11/1994 | Sandrin | 222/326 |
| 5,405,338 | A * | 4/1995 | Kranys | 604/524 |
| 5,667,102 | A * | 9/1997 | Keller | 222/95 |
| 6,851,579 | B2 * | 2/2005 | Savage et al. | 222/107 |
| 7,252,212 | B2 * | 8/2007 | Anjanappa et al. | 222/327 |
| 7,387,222 | B2 * | 6/2008 | Thompson et al. | 222/527 |

* cited by examiner

*Primary Examiner* — Paul R Durand
*Assistant Examiner* — Andrew P Bainbridge
(74) *Attorney, Agent, or Firm* — Steven H Greenfield; Greenfield Invention and Patent Consulting Inc.

(57) ABSTRACT

A device for dispensing materials and a method for operating the device are disclosed. An embodiment of the device comprises a tube, a disk for transferring piston pressure to the material to be dispensed and a pliable cone-shaped plastic nozzle attached to the tube. A tab attached to the disk enables latching on with a hook and removal of the disk when the material is in the tube is depleted, thus allowing refilling the tube as needed. Metal in the form of wire strands, wire mesh or coil is imbedded in the walls of the nozzle and provides pliability to the nozzle, but prevents recoil due to the characteristic memory of plastics.

10 Claims, 8 Drawing Sheets

10
11
12
13
14
15
16
17
18
19

DEVICE FOR DISPENSING MATERIALS FROM A CONTAINER

RELATED APPLICATIONS

This application claims priority from provisional application No. 61/151,703 filed on Feb. 17, 2009.

FIELD OF THE INVENTION

The present invention generally relates to a device for dispensing materials from a tube or a container. Embodiments of the present invention pertain to a device that may be refilled and configured to deliver the materials to areas that are hard to reach. The materials include but are not limited to: plaster, dish detergent, adhesives, grease, joint compounds, caulking and dry wall compounds.

BACKGROUND OF THE INVENTION

Material dispensing devices of the prior and present art, and particularly devices for dispensing caulking, typically comprise of a hollow plastic tube containing caulking material and a tapered nozzle attached at its wide end to the discharge end of the tube. A plastic tip covers the nozzle discharge opening located at the nozzle narrow end. To dispense the caulking material out of the tube, the tube is placed in a caulking gun, the end of the tip is cut to expose the discharge opening and the caulking gun is activated to squeeze out a desired amount of caulking. A cap may then be placed onto the narrow discharge end of the nozzle to prevent accidental caulking discharges and prevent the rapid drying of the caulking that may result in clogging of the nozzle. A nozzle may be melded in with the caulking tube or threaded onto the tube as a separate piece.

When a tube used for dispensing materials is empty, it is normally disposed of. This increases the load to landfills and increases the cost to consumers. It would be therefore desirable to provide a refillable, and therefore reusable, tube.

The nozzles through which the caulking discharges are commonly made of substantially rigid plastic materials and configured as straight extensions of their respective caulking tubes. Straight rigid nozzles may be unusable in some tight spaces, whereas bent or bendable nozzles may reach these areas. It would therefore be beneficial to provide a nozzle adjustable into various shapes and angles that enable it to fit into tight spaces and reach many otherwise hard to reach places. A number of prior art references disclose bendable nozzles for caulking tubes.

U.S. Pat. No. 6,076,712 discloses caulk tube nozzle comprising a tapered nozzle end portion, and accordion flexible section, a caulk tube attachment portion and four angled caulk tube gripping structures.

U.S. Pat. No. 5,346,380 teaches a caulking tube extension nozzle engagable to a caulking tube for facilitating a distribution of caulk onto hard-to-reach or awkwardly positioned areas. The extension nozzle includes a nozzle coupling assembly engagable to both soft plastic caulking nozzles and threaded nozzle receivers provided on caulking tubes having detachable nozzles. The coupling assembly tapers into a elongated extension tube having a flexible section which allows the extension tube to be bent while still permitting fluid flow through.

U.S. Pat. No. 7,387,222 relates to a bendable caulking nozzle extension device for use with a caulking tube having a nozzle, said device comprising an elongated tube portion extending between a proximal base portion and a distal tip portion, and having a hollow passageway defined therein. The elongated tube portion is constructed from a flexible, resilient material that may be repeatedly and forcibly deformed. An attachment means is positioned within the proximal base portion for releasably affixing said device to the nozzle of the caulking tube. A deformable stiffening element is positioned on the elongated tube portion, and is constructed of a material that allows it to be repeatedly and forcibly deformed whilst substantially retaining such deformed configuration after the removal of a deforming force.

Caulking material flowing from the caulking tube flows into said hollow passageway, and out of the exit aperture of the distal tip portion to a work surface remote from the nozzle of the caulking tube.

A major disadvantage of nozzles made of bendable plastic is their characteristic of memory and thus their tendency to rebound to their original position. While this problem appears to be solved in U.S. Pat. No. 7,387,222, the solution disclosed, i.e., a single wire positioned in the passageway of the nozzle, has the deficiencies of 1) partially blocking the flow of caulking and 2) a single metal wire provides an uneven distribution of the bending forces which reduces the nozzle's ability to produce a wide variety of bending angles.

SUMMARY OF THE PRESENT INVENTION

The present invention relates to a refillable device for dispensing flowable materials such as plaster, dish detergent, adhesives, grease, joint compounds, roofing sealants, roofing cement, caulking and dry wall compounds. Embodiments of the device are configured to discharge the materials in typically hard to reach places.

In one aspect of the present invention, a device for dispensing materials comprising: a container having an interior space, side walls, an exterior surface, and a discharge side having an opening; and a pliable cone shaped nozzle having a base, a discharge tip having an opening, an interior wall and an exterior wall, said interior wall and exterior wall extending from the base of the nozzle to the discharge tip of the nozzle, said base of the nozzle being in communication with the opening of said discharge side of the tube.

In another aspect of the present invention, a method for operating a device for dispensing materials, the device containing a tube having an open bottom and a discharge, a disk containing a pull tab adapted to fit in the tube open bottom and a first nozzle having a base and a tip, the base being in communication with the tube discharge, the method comprises: filling the tube with appropriate materials to be dispensed; inserting the disk into the open bottom; removing a portion of the tip from the first nozzle to expose an material passage opening; applying pressure onto the disk, the disk transferring the pressure to the dispensing material, the pressure resulting in squeezing out a desired amount of dispensing material; and when the dispensing material is substantially dispensed, removing the disk.

These and other features, aspects and advantages of the present invention will become better understood with reference to the following drawings, description and claims.

DETAILED DESCRIPTION OF THE INVENTION

Figures 1A, 1B, 1C, 1D, 1E:
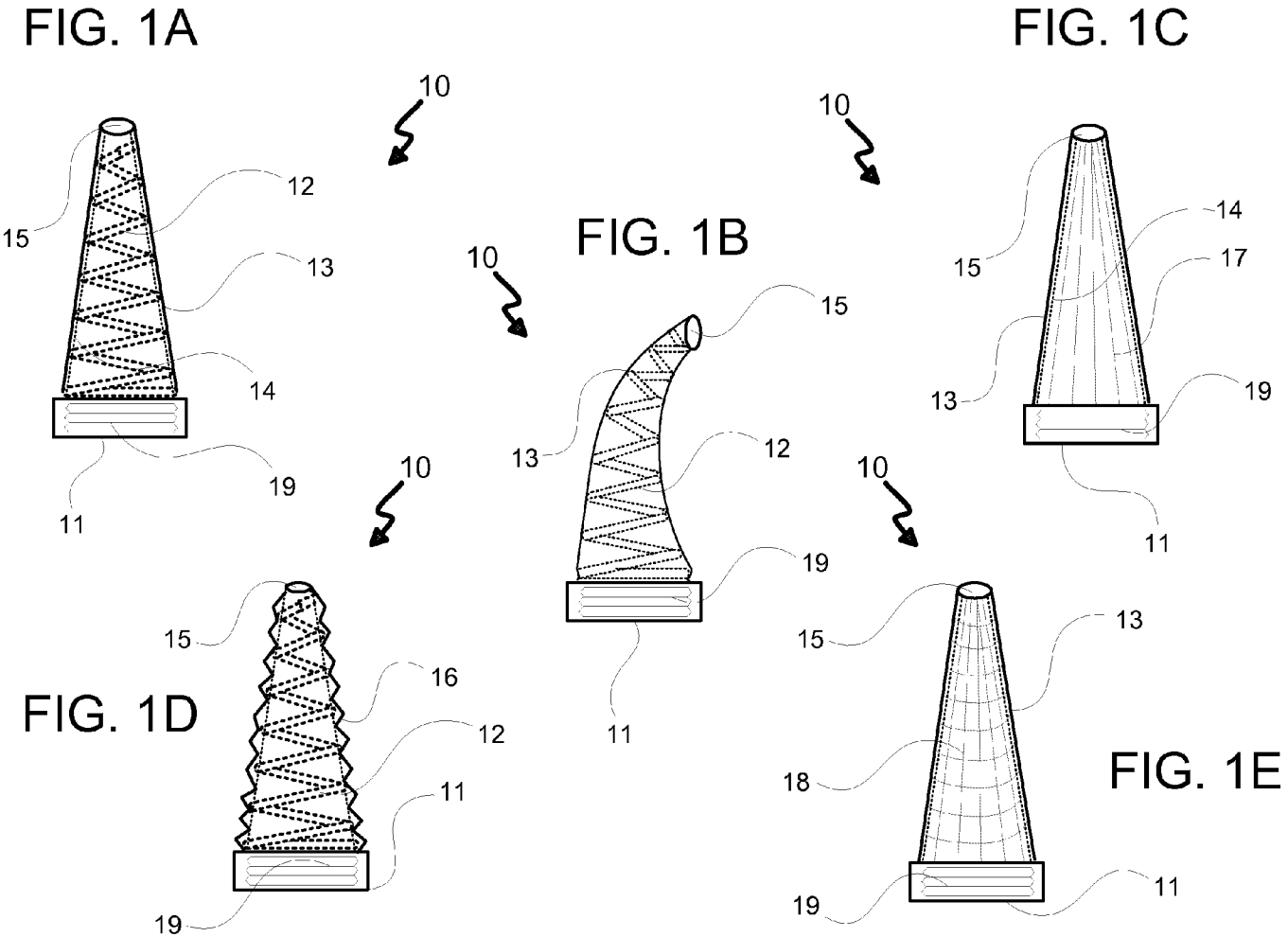
FIG. 1A is a side cross sectional view of the nozzle component of the device containing a pliable coil in an unbent position according to an embodiment of the present invention.
FIG. 1B is a side cross sectional view of the nozzle component of the device featuring a pliable coil in a bent position according to an embodiment of the present invention.
FIG. 1C is a side cross sectional view of the nozzle component of the device containing a plurality of pliable strands according to an embodiment of the present invention.
FIG. 1D is a side cross sectional view of the nozzle component of the device featuring a pliable coil in an unbent position and having an accordion shaped outer wall according to an embodiment of the present invention.
FIG. 1E is a side cross sectional view of the nozzle component of the device containing a wire mesh according to an embodiment of the present invention.
Figure 2:
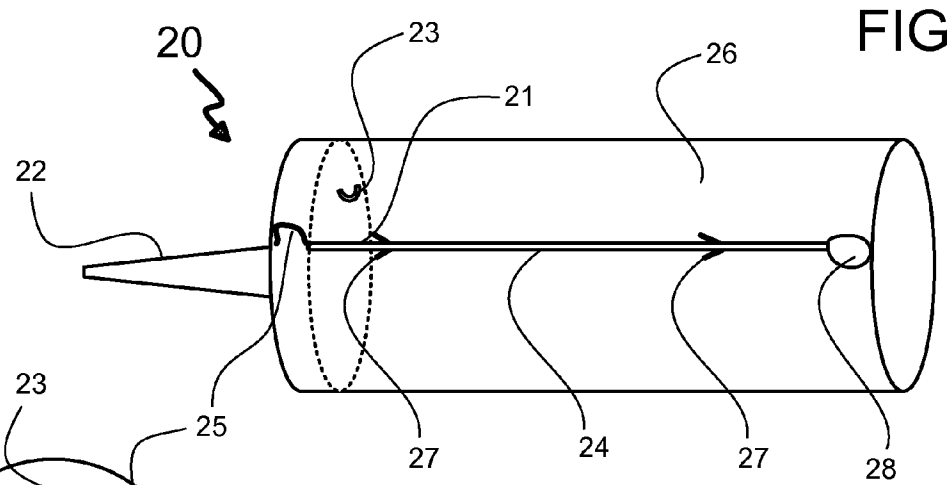
FIG. 2 is a side cross sectional view of the device showing the tube, nozzle and disk according to an embodiment of the present invention.
Figure 3:
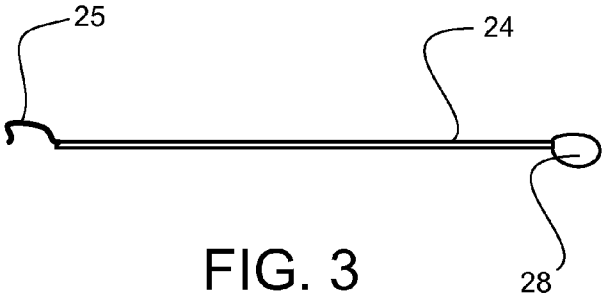
FIG. 3 is a side view of a rod having a hook at one end for removing the disk from the tube according to an embodiment of the present invention.
Figure 4:
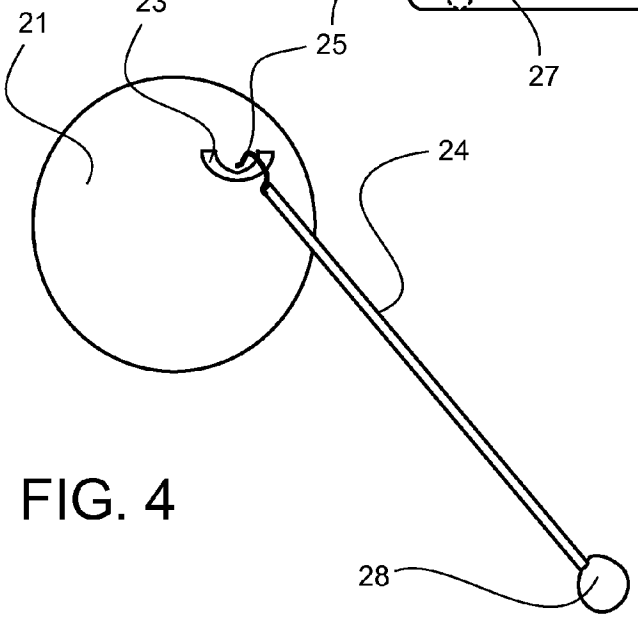
FIG. 4 is an exploded view of the device showing a rod having a hook latch onto to the tab attached to the disk according to an embodiment of the present invention.
Figure 5:
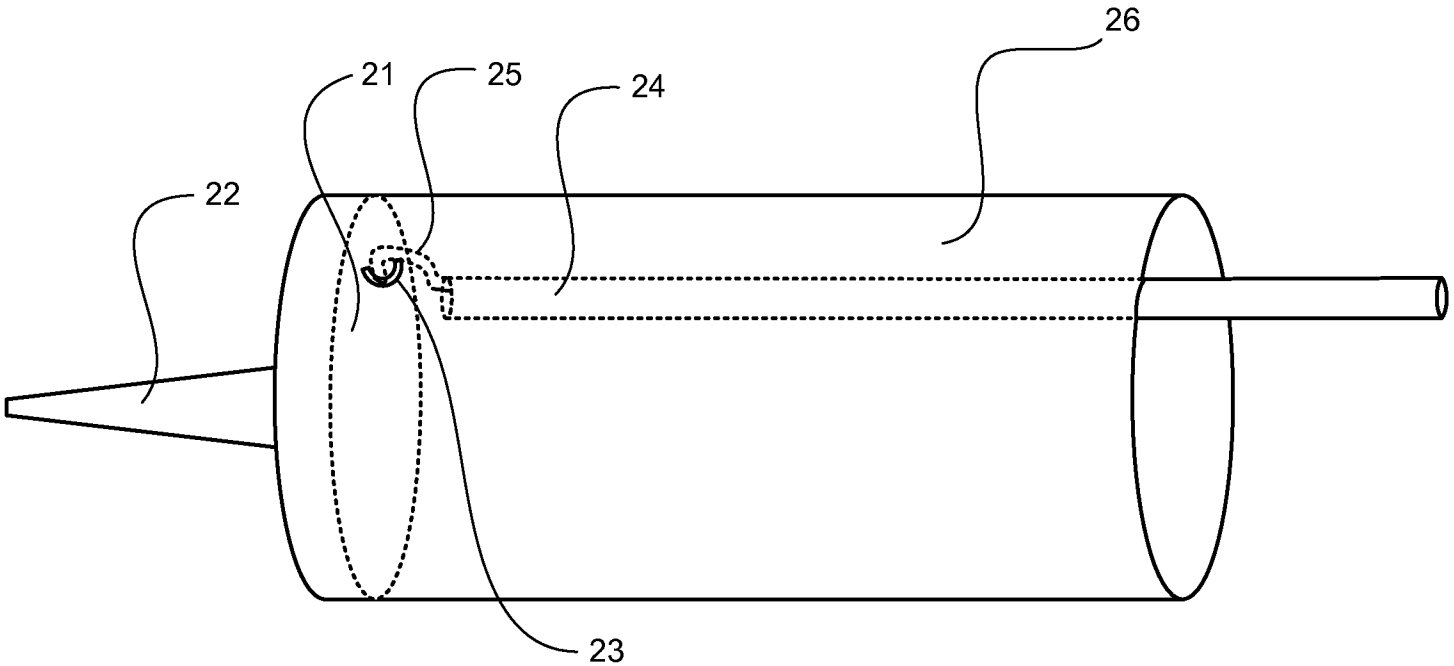
FIG. 5 is a side cross sectional view of the device showing a rod having a hook at one end latch onto the tab on the disk according to an embodiment of the present invention.

In an embodiment of the present invention, the device comprises a refillable container for dispensing liquids such as an oil canister. A dispensing nozzle attached to the container is pliable allowing adjusting the direction and angle of bending, while avoiding recoil and thus preserving its shape after the user makes the adjustment. This feature enables the tip of the nozzle to reach and pour out liquids from the container into hard to reach places. A cap may be placed on the tip of the nozzle to block the passageway when material is not dispensed.

In another embodiment of the present invention, the container is configured in the shape of a tube having a commonly cylindrical shape forming cylindrical side walls, an open bottom and an opening at the top. A tapered nozzle attached to the top of the tube is in communication with the tube and extends the passageway from the tube. A cap may be placed on the conical tip of the nozzle to block the passageway when material is not dispensed. A disk that tightly matches the bottom opening of the tube is inserted into the bottom of the tube after the tube is filled with the material to be dispensed. Removing the cap from the nozzle enables material flow through the nozzle tip when pressure is applied to the disk. This nozzle configuration may be used for dispensing relatively viscous fluids or powders that require pressure to effect fluid flow through the nozzle. As the material is depleted, the disk is pushed further and further into the inside of the tube. The disk contains a tab attached onto the side facing the outside of the tube onto a position that is off the disk center and near its periphery. The tab serves as an anchor for remotely removing the disk. This may be accomplished by gripping onto the tab with a mechanical arm; for example, a hook attached to a long rod. The user latches the hook onto the tab and tugs the rod toward the bottom of the tube. The position of the tab near the periphery of the disk causes the tug to tip the disk toward the bottom and side wall of the tube. After the disk is tipped in this manner, pulling the disk out is easy. The rod may be stored by fastening to clips attached to the tube exterior surface.

The tube, the nozzle and the disk may be made of plastic, but other materials such as wood and metal also fall within the scope of the present invention. Applying pressure to the disk may be accomplished by a using a piston, a dispensing gun, or a similar device. The disk transfers the pressure to the material resulting in material dispensation through the discharge of the nozzle.

The nozzle of the present invention is cone-shaped and configured to be pliable yet maintain its shape once deformed. The characteristic of pliability and resiliency is accomplished by imbedding metal into the side walls of the nozzle cone. The metal may be a mild, bendable steel or iron, but other metals and materials may be used. The metal may be imbedded in a gap between an inner wall and an outer wall of the cone, or molded into the nozzle plastic side walls. The metal may be formed as strands running alongside the walls of the nozzle, a wire mesh, or a coil winding through the nozzle circular wall. The nozzle may have a base attached to the wide side of the cone that contains self tapping metal threads. The nozzle may be threaded onto an extension attached to the top of the tube that contains appropriate size threads. Alternatively, the nozzle may be threaded onto an existing nozzle that is melded onto the tube and is an integral part of it, by using its self tapping threads. This makes this type of a nozzle adaptable for attaching to a variety of containers and tubes.

The nozzle may be manufactured of plastic made from any number of compositions including but not limited to polypropylene, polyethylene, nylon and styrene.

The device of the present invention is depicted in FIGS. 1A-1E and 2-6.

Embodiments of the nozzle 10 include a coil 12 imbedded between the inner wall 14 and outer wall 13 of the nozzle 10. The nozzle of the present invention include a base 11 containing self tapping threads 19 and discharge opening 15 through which the materials are dispensed. Embodiments of the nozzle 10 also include a plurality of pliable metal wire strands 17 and a wire mesh 18 imbedded between the inner wall 14 and outer wall 13 of the nozzle 10. The outer wall may be formed into accordion shaped pleats 16. These embodiments are illustrated in FIGS. 1A-1E.

Embodiments of the device 20 shown in FIGS. 2-5 include the pliable nozzle 22 attached to the tube 26 and the removable disk 21. The disk contains a tab 23 attached to a surface of the disk 21 and is used for gripping onto using a hook 25 attached to a rod 24. Clips 27 provide a means for storing the rod 24 with the device 20. Loop 28 provides a means for gripping the rod 24 tightly when reaching for the tab 23.

Figure 6:
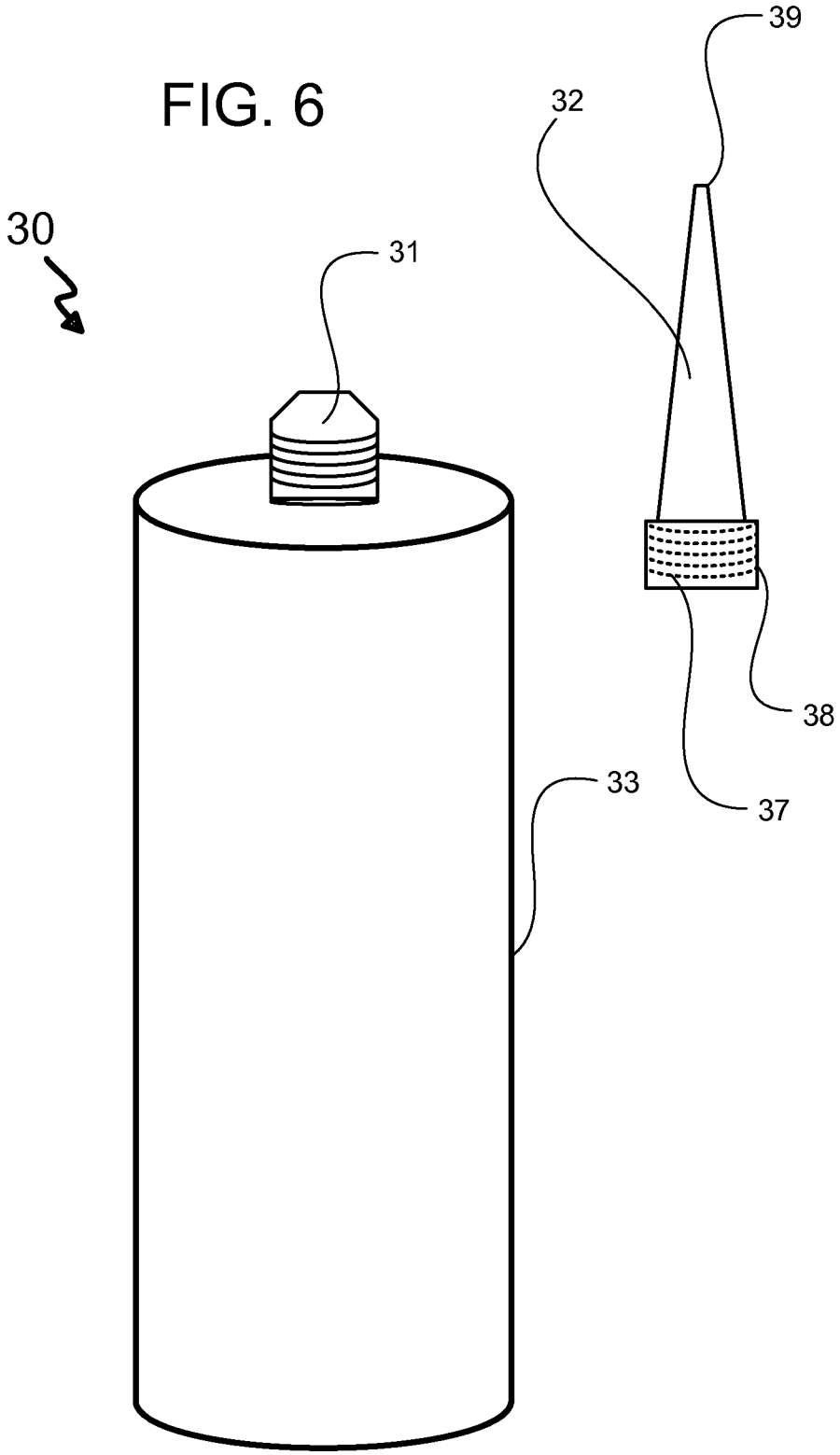
FIG. 6 shows a side view of the tube having a threaded extension for threading on a nozzle containing self tapping threads according to an embodiment of the present invention.
Figure 6A:
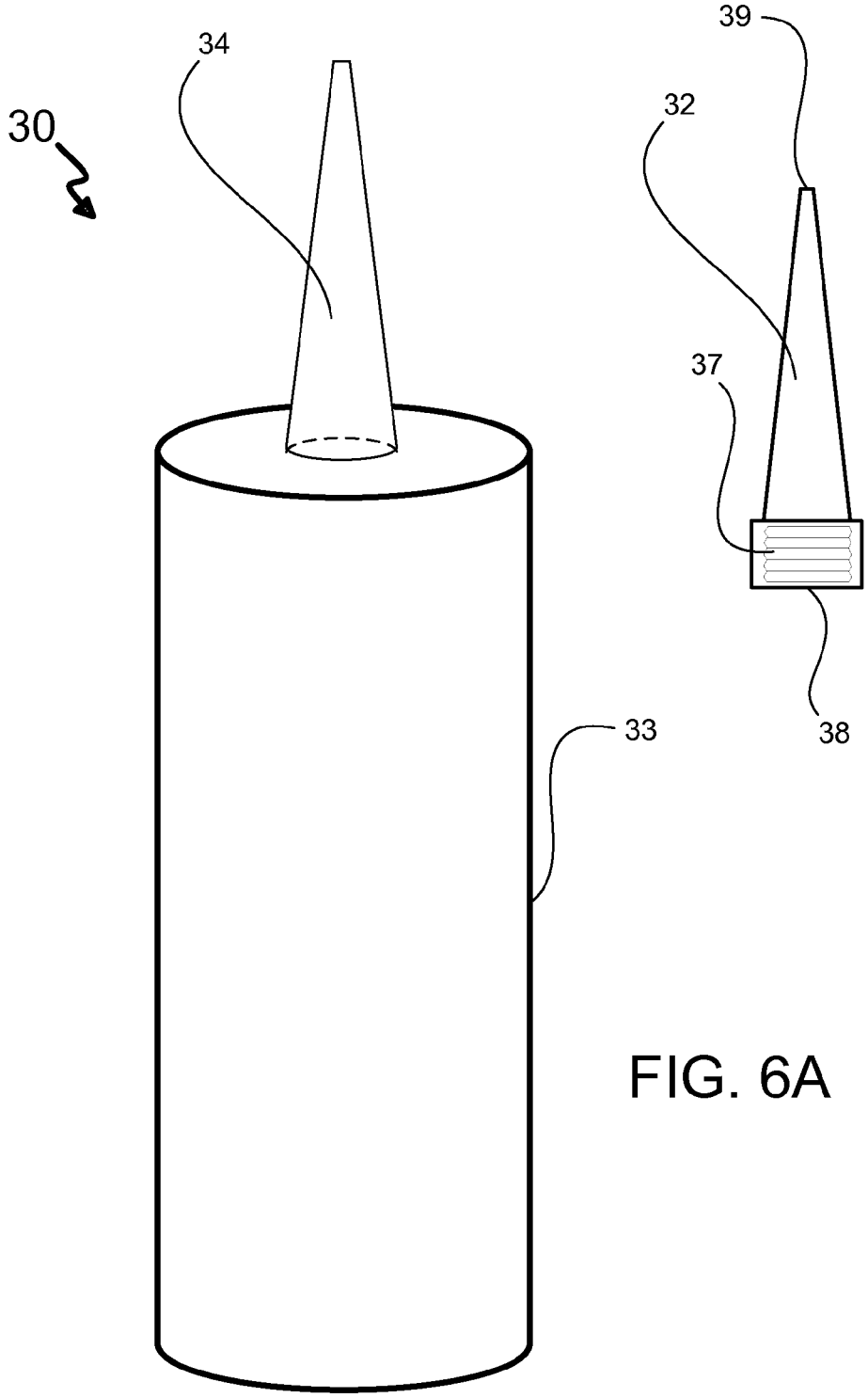
FIG. 6A shows a side view of the tube having an attached nozzle and a separate nozzle containing self tapping threads according to an embodiment of the present invention.
Figure 6B:
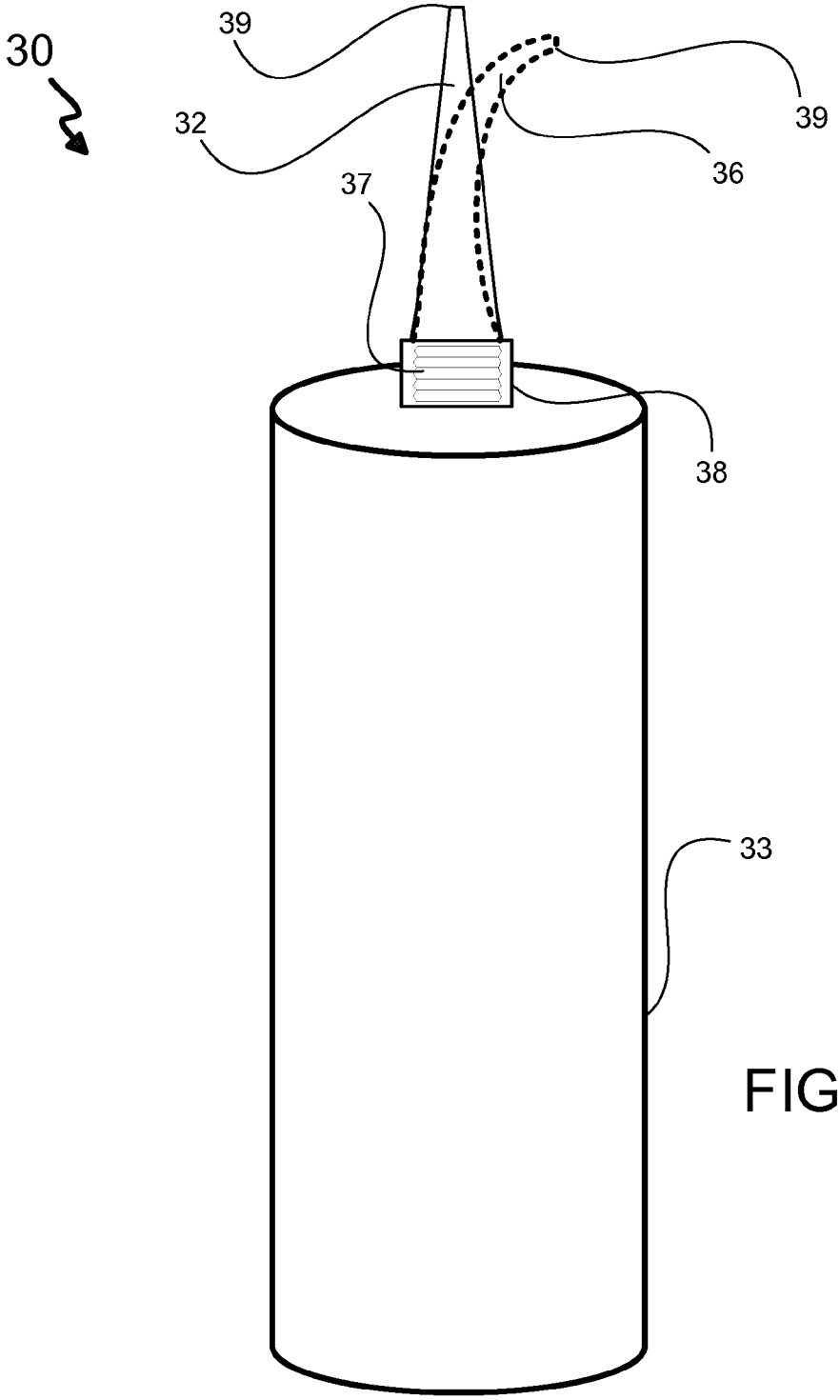
FIG. 6B is a side view of the nozzle containing self tapping threads threaded onto a tube showing the nozzle in straight and bent positions according to an embodiment of the present invention.
Figure 6C:
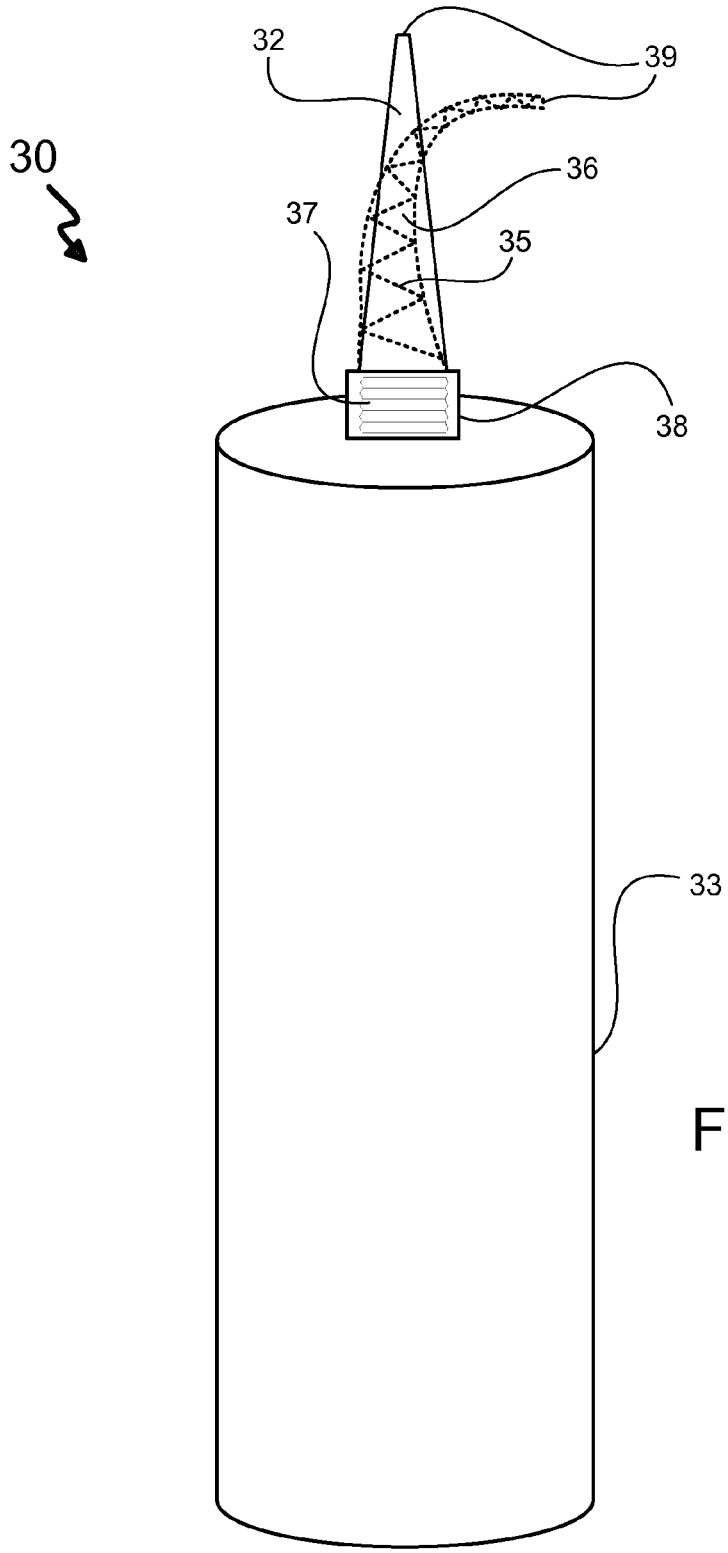
FIG. 6C is a side view of the nozzle containing self tapping threads having a coil imbedded inside its walls threaded onto a tube showing the nozzle in straight and bent positions according to an embodiment of the present invention.

Configuration embodiments for using the device 30 illustrated in FIGS. 6-6C feature an unattached pliable nozzle 32 used in conjunction with a tube 33. The nozzle has a discharge tip opening 39 and a base 38 containing self tapping threads 37. The nozzle may be threaded to a tube 33 having a threaded extension 31, or it may be used to thread onto a non-pliable nozzle 34 attached to the tube 33 using its self tapping threads 37. The unattached nozzle is shown in bent positions 36 and having a coil 35 imbedded between the inner and outer walls.

Figure 7:
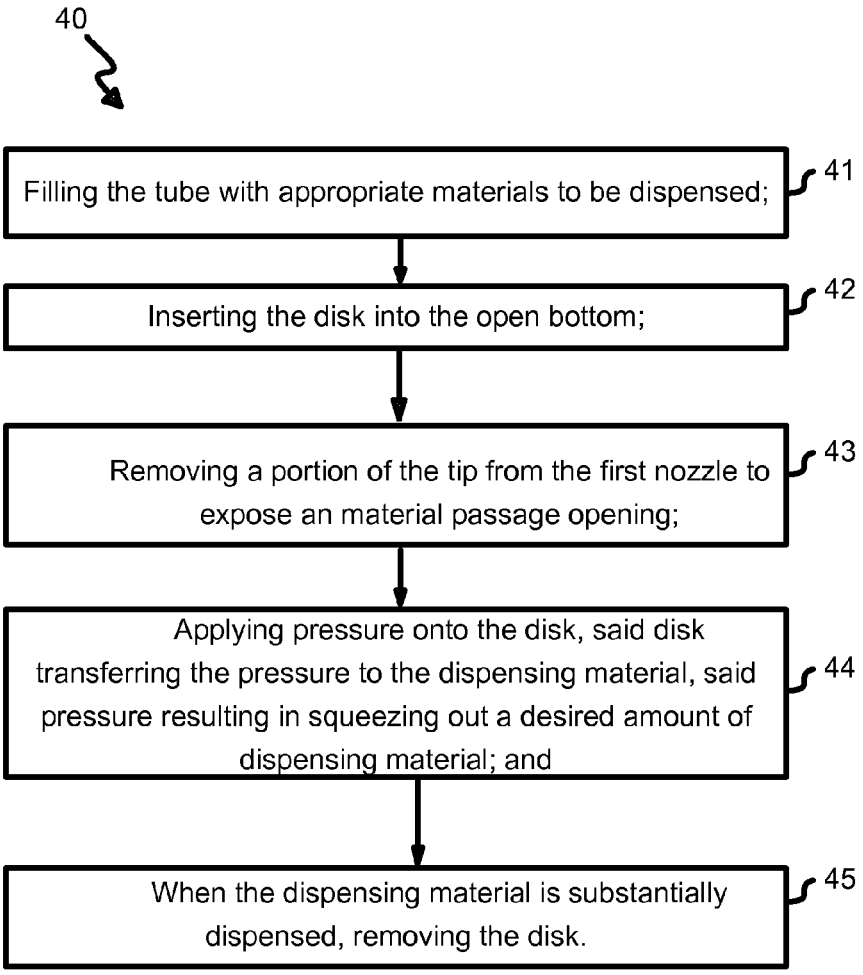
FIG. 7 is a flow chart of a method for operating a device for dispensing materials according to an embodiment of the present invention.

A schematic of the method for operating the device 40 is provided in FIG. 7. With the disk removed from the tube, the tube may be filled with the material to be dispensed 41. This may be a detergent, adhesive, grease or a dry wall mix. The disk is then fitted to the open bottom of the tube 42. The end of the nozzle tip would then be cut to expose the nozzle opening 43 and allow the material to be dispensed through the tube and nozzle. This may be accomplished by applying pressure onto the disk 44, such as using a dispensing gun or another means for applying pressure while holding the tube in a fixed position. These steps may be repeated until the tube is substantially empty, at which time the disk is removed 45 and the tube refilled with the material to be dispensed.

Pliable plastic may be made from any number of compositions including but not limited to polypropylene, polyethylene, nylon and styrene.

The nozzles of the present invention are configured to adapt to various tubes and containers. Nozzle length and diameter will thus vary depending on the application. The length of the nozzle for dispensing materials may range from about 1.0 inch to about 3.0 inches and the diameter may range from about 0.3 inches to about 2.0 inches.

I claim:

1. A device for dispensing materials comprising:

a container having an interior space, side walls, an exterior surface, and a discharge side having an opening;

a pliable cone shaped nozzle having a base, a discharge tip having an opening, an interior wall and an exterior wall, said interior wall and exterior wall extending from the base of the nozzle to the discharge tip of the nozzle, said base of the nozzle being in communication with the opening of said discharge side of the tube; and a plurality of pliable strands disposed longitudinally in a gap between the interior wall and the exterior wall of said nozzle, said strands containing a pliable metal, said metal retaining its shape after being subjected to a deforming force.

2. The device of claim 1 wherein the container is configured in a shape of a tube, said tube further comprising a bottom side having an opening, said tube containing a disk adapted to fit the opening of the bottom side of the tube, said disk having an interior side and an exterior side.

3. The device of claim 2, further comprising a pull tab attached to the exterior side of the disk, said pull tab being disposed on a peripheral portion of the disk, said pull tab being adapted for gripping onto.

4. The device of claim 2, wherein the base of the nozzle is integral with the discharge side of the tube.

5. The device of claim 2, wherein the base of the nozzle contains self tapping threads, said self tapping threads being threaded onto the discharge side of the tube.

6. The Device of claim 5, wherein the nozzle is threaded onto an extension of the discharge side of the tube, said threads on the extension being opposite those of the self tapping threads.

7. The device of claim 2, wherein the tube is adapted to fit in a dispensing gun.

8. The device of claim 1, wherein a length of the nozzle for dispensing materials ranges from about 1 inch to about 3 inches.

9. The device of claim 1, wherein a diameter of the base of said nozzle ranges from 0.3 inches to about 2 inches.

10. The device of claim 3, further comprising a rod containing a hook on one end, said rod being fastened to clips attached to the exterior surface of the tube, said hook being adapted for gripping onto the pull tab.

* * * * *